US009965902B2

(12) United States Patent
Wenninger

(10) Patent No.: US 9,965,902 B2
(45) Date of Patent: May 8, 2018

(54) METHOD FOR CONTROLLING ENTRY AND EXIT TO PARKING GARAGES AND PARKING FACILITIES

(71) Applicant: Christian Wenninger, Groedig/Salzburg (AT)

(72) Inventor: Christian Wenninger, Groedig/Salzburg (AT)

(73) Assignee: SKIDATA AG, Groedig/Salzburg (AT)

( * ) Notice: Subject to any disclaimer, the term of this patent is extended or adjusted under 35 U.S.C. 154(b) by 644 days.

(21) Appl. No.: 14/452,560

(22) Filed: Aug. 6, 2014

(65) Prior Publication Data

US 2015/0095123 A1 Apr. 2, 2015

(30) Foreign Application Priority Data

Aug. 6, 2013 (EP) ..... 13179400

(51) Int. Cl.
*G07B 15/00* (2011.01)
*G07B 15/04* (2006.01)

(52) U.S. Cl.
CPC ..... *G07B 15/00* (2013.01); *G07B 15/04* (2013.01)

(58) Field of Classification Search
CPC ..... G07B 15/00; G07B 15/04
(Continued)

(56) References Cited

U.S. PATENT DOCUMENTS 5,991,749 A * 11/1999 Morrill, Jr. ..... G06Q 20/04 705/13
6,101,375 A * 8/2000 Tuttle ..... H04W 52/50 455/127.2

(Continued)

OTHER PUBLICATIONS

"Radio Sleep Mode Optimization in wireless sensor networks", IEEE Transactions on mobile computing, vol. 9, No. 7 Jul. 2010, all pages (Year: 2010).*

*Primary Examiner* — Kevin H Flynn
*Assistant Examiner* — Omar Zeroual
(74) *Attorney, Agent, or Firm* — Karl F. Milde, Jr.; Eckert Seamans Cherin & Mellott, LLC

(57) ABSTRACT

As part of the process for controlling entry and exit in parking garages and parking facilities, the entrance or exit, in front of which a vehicle stands, is determined on the basis of a location determination of the vehicle, where the location information shall be transmitted by means of the mobile device via a wireless or mobile phone standard to a server, which is capable of controlling the parking barriers of entrances and exits after locating the vehicle, where in the case that the owner of the mobile device is already registered on the server, the user ID is also sent to the server and in the case that the owner of the mobile device is not registered on the server, the registration is done by means of the mobile device via the connection to the server and a user ID is assigned after registration, where the entrance or exit, in front of which the vehicle stands, is determined on basis of the data of location determination in the server, where a ticket in electronic form linked with the user ID is sent to the mobile device of the user in the case of an entrance or stored in the server and the parking barrier or access control device assigned to the determined entrance is actuated in order to allow the entrance, where it is determined for the case of an exit, whether the parking fee has been paid and in case of paid parking fee the parking barrier or access control device assigned to the determined exit is actuated in order to allow the exit.

3 Claims, 1 Drawing Sheet

(58) Field of Classification Search
USPC ..... 705/13
See application file for complete search history.

(56) References Cited

U.S. PATENT DOCUMENTS 6,526,335 B1 * 2/2003 Treyz ..... G01C 21/26 307/10.1
6,593,845 B1 * 7/2003 Friedman ..... G06K 19/0701 340/10.1
7,783,530 B2 * 8/2010 Slemmer ..... G06Q 10/02 340/932.2
8,198,985 B2 * 6/2012 Tiernay ..... G06K 19/0707 340/10.3
8,929,861 B2 * 1/2015 Carbonell Duque H04B 5/0031 380/247
2003/0014315 A1 * 1/2003 Jaalinoja ..... G06Q 20/045 705/18
2003/0104848 A1 * 6/2003 Brideglall ..... G06K 7/0008 455/574
2003/0122685 A1 * 7/2003 Tuttle ..... G06K 17/00 340/8.1
2004/0077383 A1 * 4/2004 Lappetelainen .. H04W 52/0229 455/574
2006/0103535 A1 * 5/2006 Pahlaven ..... G06K 7/0008 340/572.1
2007/0024423 A1 * 2/2007 Nikitin ..... G06K 19/0723 340/10.1
2007/0205873 A1 * 9/2007 Mickle ..... G06K 19/0707 340/10.33
2008/0200166 A1 * 8/2008 McCamon ..... H04W 48/16 455/426.1
2008/0224873 A1 * 9/2008 Yeo ..... G06K 7/0008 340/572.4
2009/0218891 A1 * 9/2009 McCollough, Jr. ..... H02J 17/00 307/154
2009/0224890 A1 * 9/2009 Kim ..... G06K 19/0705 340/10.33
2009/0322582 A1 * 12/2009 Baugh ..... G08C 17/02 341/176
2009/0325539 A1 * 12/2009 Malik ..... G06O 20/32 455/405
2010/0214079 A1 * 8/2010 Desjeux ..... G06K 19/0705 340/10.34
2011/0010281 A1 1/2011 Wass
2011/0062230 A1 * 3/2011 Ward, II ..... G06Q 20/105 235/377
2012/0130775 A1 5/2012 Bogaard et al.
2012/0154174 A1 * 6/2012 Schunder ..... B60Q 9/008 340/905
2012/0265585 A1 * 10/2012 Muirbrook ..... G06Q 20/20 705/13
2012/0284209 A1 * 11/2012 Duffy ..... G07B 15/02 705/418
2013/0214041 A1 * 8/2013 Wright ..... G07B 15/02 235/378
2013/0316690 A1 * 11/2013 Wildner ..... H04W 8/22 455/418
2014/0022095 A1 * 1/2014 Tannemaat ..... G08G 1/017 340/932.2
2014/0028447 A1 * 1/2014 Howard ..... G06Q 10/087 340/10.6
2014/0335490 A1 * 11/2014 Baarman ..... A61B 5/002 434/236
2015/0108210 A1 * 4/2015 Zhou ..... H03H 7/18 235/375
2015/0325048 A1 * 11/2015 Engle ..... G06T 15/50 345/632
2016/0241999 A1 * 8/2016 Chin ..... H04W 4/021

* cited by examiner

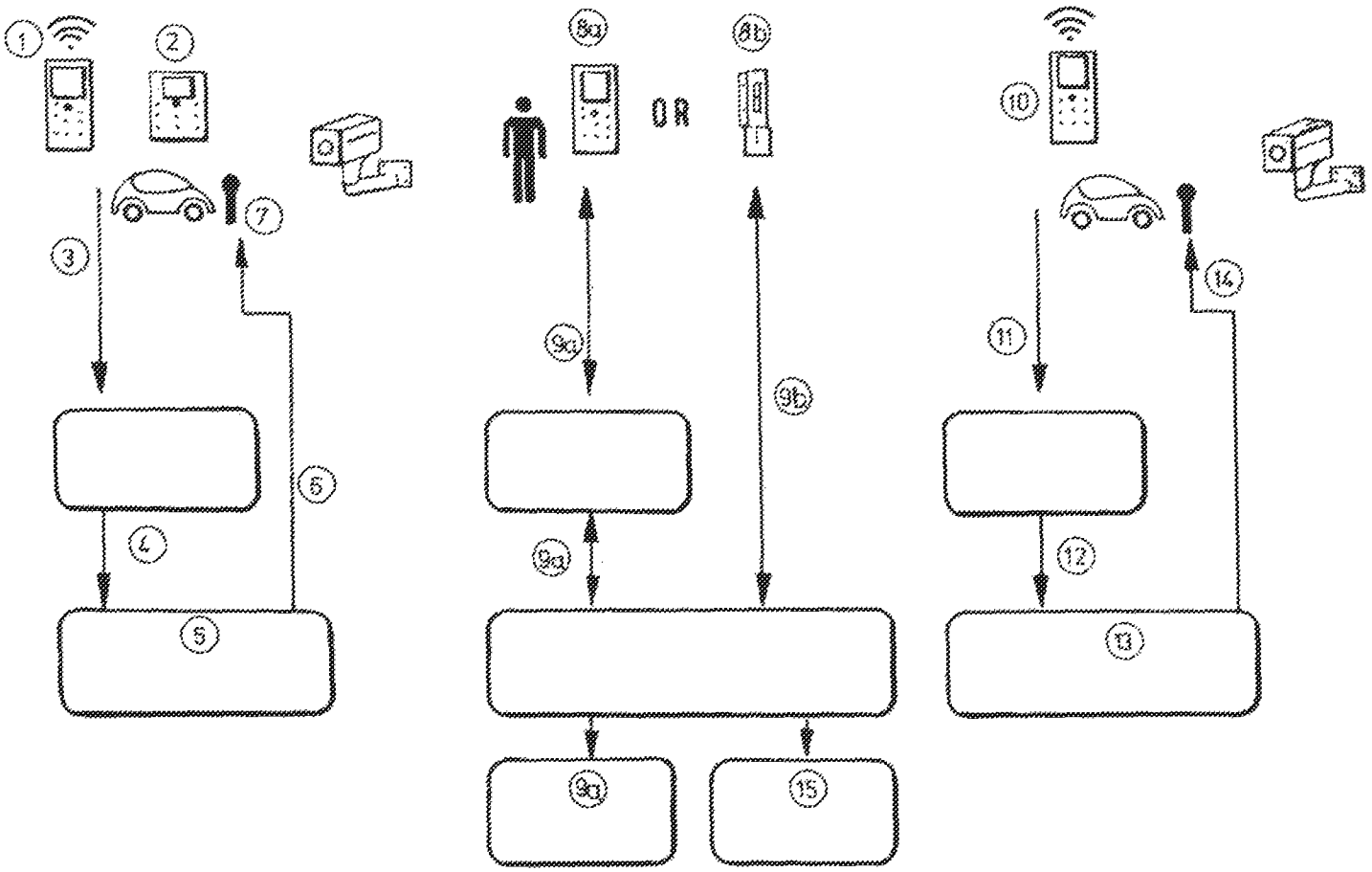
OR

METHOD FOR CONTROLLING ENTRY AND EXIT TO PARKING GARAGES AND PARKING FACILITIES

BACKGROUND OF THE INVENTION

The present invention relates to a method for controlling entry and exit to parking garages and parking facilities.

It is known from the state of art to provide parking kiosks in the entrances of parking garages and parking facilities in addition to the parking barriers, which are used to dispense tickets. Upon actuation of the parking column, a ticket is issued, where the parking barrier access control device usually designed as parking barrier is moved from the locked position to the open position in order to allow the entrance of the car to the parking garage or the parking facility.

In addition, further parking kiosks are provided at the exits of parking garages and parking facilities, which evaluate the tickets and for the case that the parking fee is paid, to control the parking barrier from a locked position to an open position to allow an exit. In general, the parking fees are paid to parking machines.

The parking kiosks constitute an additional component, which in turn increases the cost of acquisition and maintenance costs for the operators of the parking garages and parking facilities. Furthermore, it is necessary that the car drivers have to drive very close to this parking kiosks for entry or departure in order to be able to operate this, which proves to be on the one hand uncomfortable and on the other a cause for minor damages to the vehicles upon running into the parking kiosk or associated installations such as curbs or fender posts.

SUMMARY OF THE INVENTION

The present invention has taken the task as basis to provide a process for controlling the entrance and exit for parking garages and parking facilities, the implementation of which eliminates the necessity to provide separate parking columns. Moreover, the method should be carried out without the known tickets in paper form and ensure a high level of flexibility to the users at lower cost.

Accordingly, a method for controlling entry and exit for parking garages and parking facilities is proposed, under which the functionality of the parking kiosks known from the state of the art is replaced by an interaction of a mobile device located in the vehicle with functionality of a wireless link for data communication, such as a mobile phone of the driver of an outgoing vehicle with a server, which is suitable to control the parking barrier of the entrance and exit over a wireless or mobile communications standard, for example, GPRS, LTE, WLAN, for example, via the internet, where the location of the vehicle is determined, and where the entry or exit and thus the parking harrier or access control device, which the vehicle is in front of, are determined in the server based on the location information (for example, the coordinates) of the vehicle.

In terms of the invention, a connection of the mobile device to the server is a wireless link for data communication, preferably via a radio or mobile communications standard, for example, via GPRS, LTE, WLAN, for example, via the Internet or an Internet protocol.

The location determination is preferably done by a GPS module of the mobile device and/or, in the event that the mobile device features a mobile telephone functionality, via a GSM-positioning, for example, based on the cell, in which the mobile device is located.

Furthermore, other methods and apparatus known from the state of the art can be used for positioning of the vehicle, where the determined location information is transmitted to the server via the mobile device.

Another location determination can be done by the evaluation of the local Wireless Local Area Network (WLAN) connections of the mobile device known from the state of the art, in the event that the aforementioned devices cannot be used, for example, by shielding or on the other hand provide inaccurate positions. In addition, it can also be distinguished between floors or parking zones by a spatially limited wireless connection in the WLAN positioning, for which different parking fees possibly due to different service offers are to be paid.

Alternatively, the location determination can be done by scanning a QR code offered or available at the entrance/exit site containing location coordinates or the location designation via the mobile device, where the QR code can also be attached or provided at the entrance or exit of the parking garage or parking facility. For example, the QR code can be projected onto a wall or a suitable surface in order to enable scanning by the mobile device.

Another option for location determination is to use a customer medium that can be connected with the mobile device, preferably touch-free, for the purpose of data communication, for example in an ISO card format, which communicates via a built-in RF transceiver with at least one reading device assigned to a parking barrier or access control device in a predetermined frequency range, where the location information of the entrance or exit or the parking barrier is transmitted by the reading device to the customer medium, if the customer medium is detected by the reading device, which is transmitted from the customer medium to the mobile device, from which it is then forwarded to the server.

The customer medium preferably comprises a first and a second antenna which are designed on a PCB substrate. The antennas of the customer medium can be designed as dipoles, folded dipoles, "inverted F" antenna, quadrupole antennas, similar patch antennas or antenna loops and coils.

Here, the first antenna is preferably designed in the range 13 MHz--10 GHz and is used as a wake-up antenna for receiving a wake-up signal when the customer medium is in a "sleep" mode. The wake-up signal is preferably transmitted as amplitude-modulated, and includes a predetermined signal sequence, where the signal received by the wake-up antenna is amplified and demodulated by an operational amplifier serving as a wake-up detection module, and is evaluated by a microprocessor partially activated in the "sleep mode", where in case of a detected valid wake-up signal, i.e. a signal with the proper sequence, the microprocessor is fully activated and the transceiver of the customer medium is turned on, by which the customer medium enters an active mode.

The operational amplifier is the only component of the customer medium that is fully active in the "Sleep"-mode, and is configured in such a manner that it has a minimum power consumption. In addition, only a part of the microprocessor is activated in the "sleep mode".

The second antenna likewise receives and transmits preferably in the range of 13 MHz-10 GHz and is connected to an RF transceiver, where the transceiver can be activated only if the customer medium in active mode, thus minimising the energy consumption of the customer medium. The bit rate of the transceiver is preferably 1 or 2 Mbit/s. Data communication with corresponding reading devices can be performed via the transceiver over multiple channels with slightly different frequencies in order to avoid interference with external services in this way and to allow rapid contact.

In order to reduce a risk of disruption during data transmission, a continuous change of the data channels is enabled by the transceiver (frequency hopping) in accordance with another embodiment. For example, three "advertising channels" can be used for data transmission via the second antenna in the 2.4 GHz band to make contact with a reading device, and five "communication channels" can be used for data communication with the reading device. Alternatively, the reporting and subsequent data transmission is done via "ultra wideband" communications. These cover a frequency range of at least 20% of the bandwidth with respect to the centre frequency or can utilise more than 500 MHz bandwidth.

The first and the second antenna are used for long-range data communication with at least one reading device for detecting a media information of the client medium for reading out the data stored in the customer medium and/or for describing the customer medium and/or for transmitting a data stream to the customer medium. Long-range data communication in terms of the invention is a data communication with a range of more than one meter.

The customer medium therefore features a "sleep" mode and an active mode, where only the operational amplifier and a part of the microprocessor are activated in the "sleep"-mode. The microprocessor of the customer medium is largely turned off in "sleep"-mode and fully turned on in the active mode, where the transceiver is turned off in "sleep"-mode and in idle mode and is turned on only in active mode. In this way, the energy consumption of the customer medium is kept as low as possible.

The customer medium can be implemented as an active customer medium, where in this case a battery, preferably a 3-volt battery is provided to provide electricity to the components. Optionally, the customer mediitm can feature an LCD display and an appropriate driver and/or a device for visual and/or acoustic indicator such as a low battery status or other data or conditions of the customer medium.

As part of further embodiments, the customer medium can be designed in such a manner that it is charged with energy via an HF pulse, which is emitted from at least one reading device, thus the required energy can be taken from the field of the reading device and then can be operated autonomously for a predetermined time. For this purpose, the customer medium features a capacitor for storing energy and a corresponding switching circuit. The pulse is preferably a pulse in the UHF-range.

In the event that the customer medium does not feature its own power supply, the "wake-up" signal can additionally be included in the HF pulse. Furthermore, in the event that the customer medium is connected to the mobile device, the customer medium can obtain the energy required for the operation from the device. In the case of NFC-coupling, this is achieved via the 13 MHz communication field. Over such a field, a battery of toe customer medium can also be recharged constantly.

Furthermore, the customer medium can have an appropriately dimensioned solar module to charge the battery in this way. As part of a further development of the invention, the customer medium has means for entering a PIN which can be implemented as a numeric keypad and/or at least one biometric sensor, for example, a fingerprint sensor in order to check the authorisation for the use of a customer medium by a person.

The connection of the customer medium with the mobile device can be implemented using NFC (Near Field Communication), where in this case, the customer medium and mobile device have the necessary NFC components. Alternatively, the connection can occur via a RFID interface, a Bluetooth®-interface or other interfaces to the data communication known from the state of the art.

The reading devices are arranged and oriented in such a way that they each cover the space located directly in front of the entrance or exit or parking barrier or access control device, so that only one vehicle in which a customer medium is located, standing directly in front of the entrance or exit or parking barrier or access control device can be detected. In this way it is avoided that several vehicles are detected at the same time, which can lead to problems, for example if the parking barrier is opened for the exit of the rear vehicle, and instead of the rear vehicle, the vehicle standing directly in front of the parking barrier passes the barrier. A preferred embodiment implements a range measurement between reader and customer medium, as it can be implemented based on ultra-wideband communication. In this way, the distance can then be surely estimated and this will only be opened for the vehicle position directly in front of the parking barrier.

In case of a wake-up signal detected as valid, the customer medium enters the active mode and transmits a predetermined signal, for example, the tasar ID to the reader, which transmits the location information, for example in the form of coordinates or a location designation to the customer medium after receiving this signal. Optionally, the receipt of the location information can be acknowledged by the customer medium by emitting another predetermined signal. Furthermore, it can be provided that the customer medium enters the sleep mode to minimize power consumption after a predetermined time after receiving the location information.

After successful location determination, these data are transferred to a server via a wireless link for data communication, preferably via a wireless- or radio communications standard, for example, via GPRS, LTE, WLAN, for example via the Internet, for example by means of a software or app of the mobile device, where the entrance or exit and thus the determined parking barriers or access control device assigned to the entrance or exit, in front of which the vehicle is standing, are determined on basis of the transmitted location information. In the case that the owner of the mobile device is already registered, the user ID is also transmitted or determined, where corresponding parking barrier is operated based on these data from the server in order to allow the entry or exit.

As part of a further development of the invention, a proactive location determination is carried out, where as soon as the mobile device of a user approaches an entrance or exit of a parking garage or a parking facility below a predetermined distance, the user is asked via a corresponding activated software in his mobile device, whether he wants to enter or exit. Through this proactive approach, in which the location determination is already carried out, the implementation of the method can be significantly accelerated upon increasing the comfort.

In the event that the user of the mobile device is not yet registered, the registration can likewise be done via the connection of the mobile device to the server, where a user ID is assigned after successful registration.

After conveying the location data of the vehicle and the user ID, a ticket is created in electronic form in the server and sent to the mobile device of the user in accordance with a variant of the invention via a wireless link for data communication, preferably via a radio or mobile radio standard, e.g. via GPRS, LTE, WLAN, where the entrance is subsequently enabled. Here, the determined parking barrier assigned to the entrance is controlled by the server in the opening direction. The ticket can be a number, a QR code or a one-dimensional bar code. The ticket is linked with the user ID in the server.

Alternatively, the electronic ticket will be stored in the server and linked with the user ID for the transmission of an electronic ticket. By this approach, the ticket is not conveyed to the mobile device. In addition, this will enable access to a ticket via another mobile device likewise registered under the same user ID. This is conceivable, for example, in the case of a transferable permanent parking ticket, which is used by several users of the one and same vehicle.

If the user wants to exit with his vehicle, this can be done only if the parking fee has been paid, which can be done, for example, based on the software stored on the mobile device by connecting to the server. This type of payment is known from the state of the art and can be based on, for example, the transfer of account or credit card data. In case of payment, the ticket number and/or the user ID, in particular in the case that the electronic ticket is stored only on the server, are transferred so that the payment process is associated with the user ID or the number of the electronic ticket and stored in a corresponding database of the server.

Alternatively, the user can pay the parking fee at a parking ticket machine in a conventional manner, for example, with cash or a debit or credit card, where the ticket number of the electronic ticket and/or the user ID in particular in the case that the electronic ticket is stored only on the server are transmitted from the parking ticket machine to the ticket machines connected to the server, for example, via an NFC interaction between the mobile device and the parking ticket machines or by scanning the transmitted electronic ticket, which is preferably configured as a QR code or an one-dimensional bar code. Furthermore, the user may enter the number of the electronic ticket or the user ID, in particular in the event that the electronic ticket is stored only on the server, via a keyboard of the parking ticket machines. If the ticket is paid for, this process is linked with the user ID or the number of the electronic ticket and stored in an appropriate database of the server.

If the ticket is paid for, the user of the mobile device can leave the parking garage or the parking facility with his vehicle in a way analogous to the previously described procedure, if he stands in front of an exit, the location information is determined and sent to the server together with the user ID and/or the number of the electronic ticket, where the parking barrier assigned to the determined exit is controlled in the opening direction in order to enable the exit after analysis of the data from the server.

As part of a further development of the invention, the entrance is possible with an already pre-paid ticket or a parking permit, for example, as an employee of a company, where the entrance is enabled for this purpose on the basis of location determination, which is used to identify the parking barriers or access control device and on the basis of transmission of user ID after evaluation in the server. Similar procedure is carried out at the exit without the need to pay for a parking ticket, this being evaluated or determined in the server.

As part of other embodiments of the invention, information can be sent to the mobile device on basis of required location determination of the mobile device, which have, for example, points-of-interest in the vicinity of the parking garage or the parking facility or even advertising as the subject. A feedback function can also be implemented over the connection of the mobile device to the server.

The method according to the invention can be carried out without registration of the user, that is, without a user ID, where the registration step is omitted. In this case, a biunique number of the mobile device, such as the number of a SIM card or the International Mobile Station Equipment Identity (IMEI)—number of the mobile device or a telephone number assigned to this device, which is used as a user ID in the content of the method, is transferred for the identification of the mobile device.

The method according to the invention is elaborated in more detail with reference to the accompanying FIGURE. The parallelograms in the FIGURE represent different software modules.

BRIEF DESCRIPTION OF THE DRAWING

FIG. 1 is a block diagram illustrating the steps of the method according to the invention.

DESCRIPTION OF THE PREFERRED EMBODIMENT

In a first step (step 1), a pro-active location determination is carried out using a mobile telephone located in the vehicle with the appropriate activated software, where this can toe done, for example, by a GPS module of the mobile phone with high accuracy, as explained above. If the mobile phone approaches the entrance of a parking garage or a parking facility below a predetermined distance, the user is preferably asked over a software in his mobile device, whether he wants to enter, where in the case of an affirmative answer (step 2) a connection to a server is made for the transmission of location information and user ID (step 3), wherein the location information and the user ID are transmitted to the server. Based on the location information, the parking barrier assigned to the location according to the location information is determined in the server (step 4) and an electronic ticket is created (step 5), which is sent to the mobile phone via a wireless link for data communication and the corresponding software of the mobile phone or is stored on the server, where the parking barrier is controlled by the server in the opening direction (step 6) in order to allow the entrance of the vehicle in the parking facility (step 7). Optionally the license plate of the vehicle can be detected by a suitable device, where the license plate is linked with the user ID and/or the number of the electronic ticket in the server.

The payment of parking fees required for the exit can be done via the mobile phone via the connection to the server (step 8*a*), where, for example, credit card information is transmitted (step 9*a*) or the account of the user at the parking facility operator is charged accordingly, where the payment process with the number of the electronic ticket or, in particular in the case that the electronic ticket is stored only on the server, is linked with the user ID and is stored in a corresponding database of the server.

Alternatively to this approach, the parking fees may be paid in a conventional manner at a parking meter (step 8*b*), where the ticket number of the electronic ticket and/or in particular in the case that the electronic ticket is stored only on the server, the user ID can be transmitted from the parking ticket machine to the parking ticket machines via an NFC interaction between the mobile device and the parking ticket machine or by scanning the electronic ticket implemented as a QR-code or as an one-dimensional bar code, where the payment process is linked with the user ID or the number of the electronic ticket and is stored in a corresponding database of the server (step 9B).

After the settlement of the payment, the vehicle can leave the parking facility, where a location determination is carried out, for example, via a GPS module of the mobile phone located in the vehicle (step 10) and the user affirms his desire to "Exit" by operating the menu, where a connection to the server is subsequently established for transmission of the location information and the user ID and/or the number of the electronic ticket (step 11), where the location information and the user ID are transmitted to the server. Based on the location information, the parking barrier assigned to the location according to the location information is determined in the server (step 12) and it is determined, whether the parking fees have been paid (step 13). If the parking fees have been paid, the parking barrier is controlled by the server in the opening direction (step 14) in order to allow the exit of the vehicle. Here, the license plate of the vehicle can optionally be detected. She optional step 15 represents the transmission of the transaction data to a customer relationship management module, in which the documentation and management of customer relationships is carried out.

As already explained, the location information can be obtained by using a customer medium, which can preferably be connected touch-free with the mobile device for the purpose of data communication, which communicates with a built-in RF transceiver with at least one reading device assigned to a parking barrier or access control device in a predetermined frequency range. If the customer medium is detected by the reading device, the location information of the parking barrier is transmitted from the reading device to the customer medium, which is transferred from the customer medium to the mobile device. Subsequently, the location information is transmitted along with the user ID to the server.

By using a mobile device and, as the case may be, a customer medium and not a vehicle-mounted device, a person can use the method according to the invention with different vehicles without the need to install special devices in each vehicle. In addition, conventional mobile devices are used, so that the costs for the users of the method are low.

There has thus been shown and described a novel method for controlling entry and exit to parking garages and parking facilities which fulfills all the objects and advantages sought therefor. Many changes, modifications, variations and other uses and applications of the subject, invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A customer medium for use in a system for controlling entry and exit of motor vehicles in a parking facility, wherein operation of barriers at entrances and exits of the facility, in front of which a vehicle stands, is determined on the basis of a location determination of the vehicle, wherein vehicle location information is transmitted by means of a user's mobile device via a wireless or mobile phone standard connection to a server, said server being operative to control the barriers at entrances and exits after locating the vehicle, said customer medium being connectable with the mobile device and used in the location determination for the purpose of data communication via a built-in RF transceiver with at least one reading device assigned to a parking barrier or access control device in a predetermined frequency range, the location information of the entrance or exit or the parking barrier being transmitted by the reading device to the customer medium, if the customer medium is detected by the reading device, and being transmitted from the customer medium to the mobile device, from which it is then forwarded to the server;

said customer medium comprising (1) a microprocessor having an active mode and a sleep mode; (2) a first and a second RF antenna, said first antenna being operative to receive a wake-up signal when the microprocessor is in the sleep mode; and (3) an operational amplifier coupled to the first antenna, for amplifying and demodulating the wake-up signal, and coupled to the microprocessor having the active mode and the sleep mode, the microprocessor having the active mode and the sleep mode, the microprocessor being connected to the RF transceiver which, in turn, is connected to the second antenna, said microprocessor being operative, in response to the receipt of the wake-up signal, to switch on the RF transceiver to transmit and receive via the second antenna;

wherein the operational amplifier is the only component of the customer medium that is fully active in the sleep mode, wherein only a part of the microprocessor is activated in the sleep mode and wherein the RF transceiver is activated only if the microprocessor is in an active mode, thereby to minimize power consumption of the customer medium; and wherein the customer medium is configured to be charged with energy via an HF pulse that is emitted from at least one reading device, whereby energy for the customer medium is taken from the HF pulse of the reading device and is then operated autonomously for a predetermined time.

2. The customer medium according to claim 1, wherein a proactive location determination is carried out, where as soon as the mobile device of a user approaches an entry or exit of a parking garage or a parking facility below a predetermined distance, the user is asked over a corresponding software in the mobile device, whether the user wants to enter or exit, where a connection to the server is established to transmit the location information and a user ID in the case of an affirmative answer.

3. The customer medium according to claim 1, wherein payment of parking fees is made by means of the mobile device via said connection to the server or at parking ticket machine, wherein at least one of a ticket number of an electronic parking ticket and a user ID are transmitted from the parking ticket machine at an entrance to the facility via an NFC-interaction to the mobile device or by scanning the electronic ticket implemented as a QR-code or as a one-dimensional bar code on the mobile device; and wherein, if the parking fees have been paid, a payment process is linked to at least one of the user ID and the number of the electronic ticket and stored in an appropriate database of the server, so that if the user's vehicle is standing in front of an exit, the server operates the corresponding barrier in an opening direction after the transmission of the location information and at least one of the user ID and the number of the electronic ticket.

* * * * *